US005452074A

United States Patent [19]

VonHoene et al.

[11] Patent Number: 5,452,074

[45] Date of Patent: Sep. 19, 1995

[54] PROCESS COLOR AND RECHARGE WITH THE OVERCOATED P/R SINGLE PASS COLOR PROCESS

[75] Inventors: Donald C. VonHoene, Fairport; Richard L. Post, Penfield, both of N.Y.

[73] Assignee: Xerox Corporation, Stamford, Conn.

[21] Appl. No.: 237,945

[22] Filed: May 2, 1994

Related U.S. Application Data

[63] Continuation of Ser. No. 987,495, Dec. 7, 1992, abandoned.

[51] Int. Cl.[6] ..... G03G 15/01

[52] U.S. Cl. ..... 355/326 R; 355/327; 430/42; 430/54

[58] Field of Search ..... 355/326 R, 327, 328, 355/219, 210, 214, 220; 346/157, 159, 153.1, 158; 358/300, 296; 430/42, 54, 55; 347/112, 115, 117, 118, 232

[56] References Cited

U.S. PATENT DOCUMENTS

| | | | |
|---|---|---|---|
| 4,078,929 | 3/1978 | Gundlach | 96/1.2 |
| 4,467,023 | 8/1984 | Chu et al. | 430/66 |
| 4,515,462 | 5/1985 | Yoneda | 355/326 R |
| 4,721,662 | 1/1988 | Haneda | 430/55 X |
| 4,731,313 | 3/1988 | Haneda | 355/326 R X |
| 4,731,634 | 3/1988 | Stark | 355/328 |
| 4,734,735 | 3/1988 | Haneda | 355/326 R |
| 4,786,939 | 11/1988 | Haneda | 355/326 R |
| 4,789,612 | 12/1988 | Haneda et al. | 430/42 |
| 4,898,797 | 2/1990 | Gruenbaum et al. | 430/55 X |
| 4,920,024 | 4/1990 | Williams | 430/42 X |
| 5,241,356 | 8/1993 | Bray et al. | 355/328 |
| 5,258,820 | 11/1993 | Tabb | 355/328 |

FOREIGN PATENT DOCUMENTS 0203196 5/1986 European Pat. Off. .

OTHER PUBLICATIONS

Patent Abstract of Japan, vol. 11, No. 58 (P-550) (2505) 21 Feb. 1987.

*Primary Examiner*—Matthew S. Smith

[57] ABSTRACT

A method and apparatus for forming orthographic color images is disclosed. A relatively high resolution ROS is utilized to simultaneously form a plurality full contrast images thereby yielding the registration precision available in tri-level imaging while providing full contrast images of conventional xerography as discussed above.

6 Claims, 4 Drawing Sheets

PROCESS COLOR AND RECHARGE WITH THE OVERCOATED P/R SINGLE PASS COLOR PROCESS

This is a continuation of application Ser. No. 07/987,495, filed Dec. 7, 1992 now abandoned.

BACKGROUND OF THE INVENTION

This invention relates to a xerographic process and apparatus useful in electronic reprographic, orthographic color imaging system, that is imaging systems capable of creating highlight color, graphics and data plots with color coding.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation. The areas of charge dissipated on the photoreceptor correspond to residual or background voltage levels. Thus, the photoreceptor contains two voltage levels in the case of a binary digital system. In the case of a light/lens system a whole array of voltage levels are present on the photoreceptor.

This latent charge pattern is rendered visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

Conventional xerographic imaging techniques which were directed to monochrome image formation have been extended to the creation of color images including highlight color images. In one method of highlight color imaging, the images are created using a raster output scanner to form tri-level images.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided into three levels, rather than two levels as in the case in conventional xerography. The photoreceptor is charged, typically to −900 volts. It is exposed imagewise, such that one image corresponding to charged image areas (which are subsequently developed by charged-area development, i.e. CAD) stays at the full photoreceptor potential ($V_{CAD}$ or $V_{ddp}$). $V_{ddp}$ is the voltage on the photoreceptor due to the loss of voltage (otherwise known as dark decay) while the photoreceptor remains charged in the absence of light. The other image is exposed to discharge the photoreceptor to its residual potential, i.e. $V_{DAD}$ or Vc (typically −100 volts) which corresponds to discharged area images that are subsequently developed by discharged-area development (DAD) and the background area is exposed such as to reduce the photoreceptor potential to halfway between the $V_{CAD}$ and $V_{DAD}$ potentials, (typically −500 volts) and is referred to as $V_{white}$ or $V_w$. The CAD developer is typically biased about 100 volts closer to $V_{CAD}$ than Vwhite (about −600 volts), and the DAD developer system is biased about −100 volts closer to $V_{DAD}$ than $V_{white}$ (about 400 volts). As will be appreciated, the highlight color need not be a different color but may have other distinguishing characteristics. For, example, one toner may be magnetic and the other non-magnetic.

As noted above, in conventional xerography the photoreceptor contains two voltage levels whereas in tri-level xerography three voltage levels are present. Thus, with tri-level imaging the image contrast voltage is substantially reduced from that of conventional xerography. This represents a significant limitation to extending the concept of tri-level imaging to full gamut color imaging. This is because the already small, relative to conventional xerography, development field for creation of the color image must be further reduced for each color to be created.

Multiple level imaging with a ROS such as utilized in tri-level xerography, as will be appreciated, is highly desirable because of the perfect image registration that is provided thereby.

Notwithstanding the limitation of reduced contrast images, attempts have made at extending the color gamut using tri-level xerography. For example, In U.S. Pat. No. 4,731,634 granted to Stark on Nov. 3, 1986 discloses a method and apparatus for printing images in black and at least one highlight color in a single pass of the imaging surface through the processing stations of the imaging apparatus. To this end, the exposure device which is a Raster Output Scanner (ROS) is operated to form four voltage levels comprising three image levels and a background level. An even lower contrast voltage is available for creating the additional highlight color image.

BRIEF SUMMARY OF THE INVENTION

According to the present, a method and apparatus for forming orthographic color images is provided. A relatively high resolution ROS similar to the one used in the above-described tri-level process is utilized to simultaneously form a plurality full contrast, charged area images thereby yielding the registration precision available in tri-level imaging while providing full contrast images of conventional xerography as discussed above.

Using a special photoreceptor configuration and a sequence of image creation steps including a simultaneously shunting and exposure step, balanced latent images are formed across the photoreceptor structure. By balanced is meant that latent images exist across both an overcoat layer of the photoreceptor and the rest of the photoreceptor which preclude development of the image across the overcoat layer if the photoreceptor were moved past a development system. An electrostatic voltmeter used to read the surface potential would read zero or near zero volts.

Following formation of the plurality of perfectly registered images using the high resolution ROS, each of the balanced images are, one at a time, caused to become unbalanced prior to their movement past an appropriate development system. Such unbalancing is effected using a low resolution ROS or other suitable exposure device. Each low resolution ROS or other suitable exposure device would provide full exposure sufficient to discharge the photoreceptor leaving the portion of the latent image potential of interest across only the overcoating thereby enabling its development.

DETAILED DESCRIPTION OF THE PREFERRED EMBODIMENT OF THE INVENTION

Figure 1:
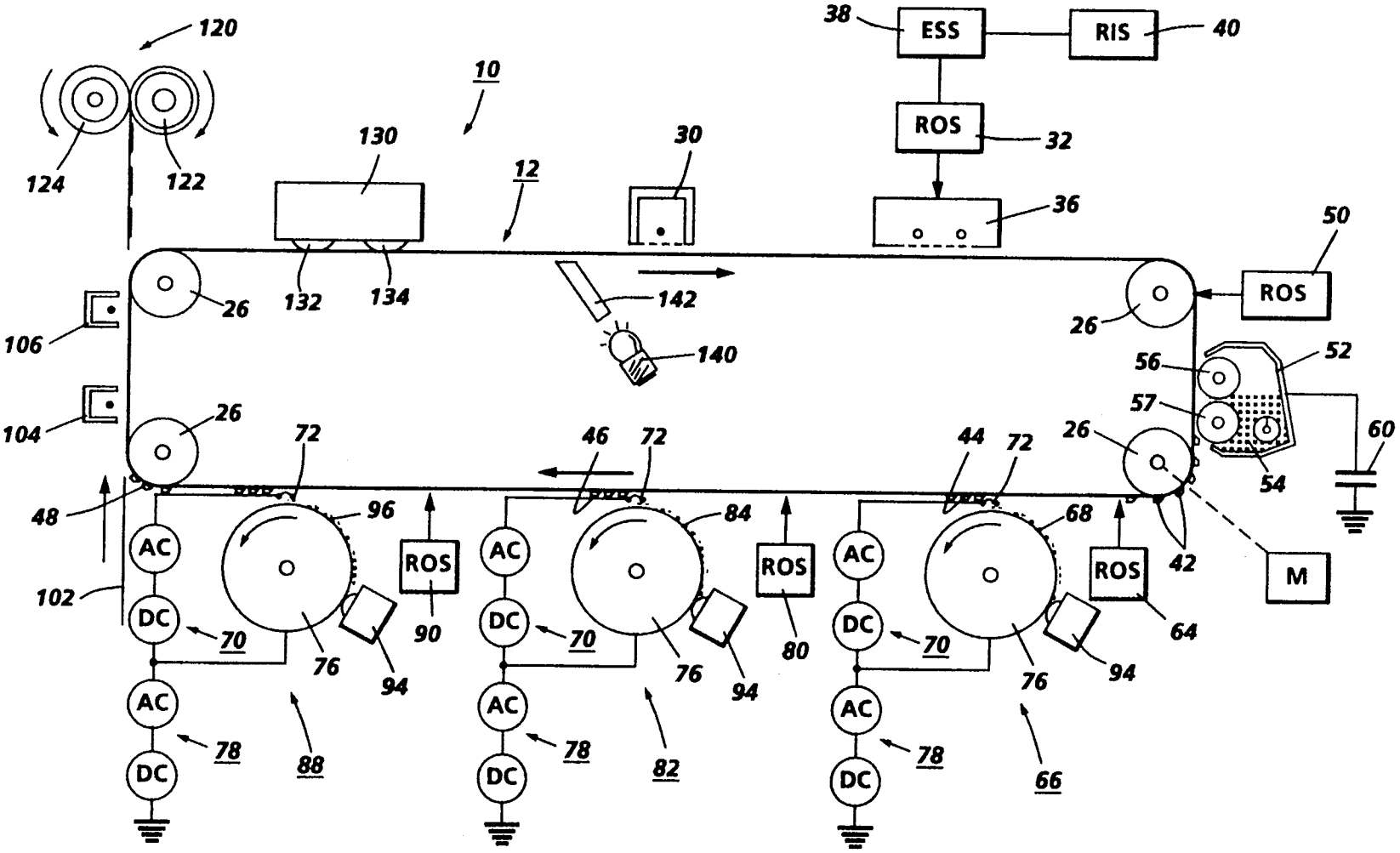
FIG. 1 is a schematic illustration of an imaging creation apparatus representing the invention.

As shown in FIG. 1 a highlight color printing apparatus 10 comprises a photoreceptor belt structure 12 (FIGS. 2 through 12). The belt, as illustrated in FIGS. 2 through 12, comprises a relatively thick (i.e. ~10 microns) overcoating layer 20 (FIGS. 2 through 12) fabricated from a polycarbonate resin such as Makrolon TM. An adhesive backed or thermally bonded layer can be used. The overcoating layer 20 serves to protect a binder generator layer (BGL) 22 fabricated by dispersing photoconductive particles such as trigonal selenium (tSe) into a film forming binder or polymer such as polyvinyl carbazole (PVK). The BGL has a thickness of ~2 microns. A transport layer 24 suitable with suitable interfaces and fabricated from polyphenyl diame active small molecules which are molecularly dispersed into a polycarbonate resin binder such as Makrolon TM forms the other layer of the photoreceptor structure 12. Because of the protection provided by the thick overcoat 20, the the generating layer 22 can be placed above the transport layer 24. The belt is entrained about a plurality of rollers 26 for movement sequentially past a plurality of xerographic processing stations. One of the rollers 26 is operatively connected to a motor 27 and associated drive mechanism for effecting movement if the belt 12 in a clockwise direction.

Figure 2:
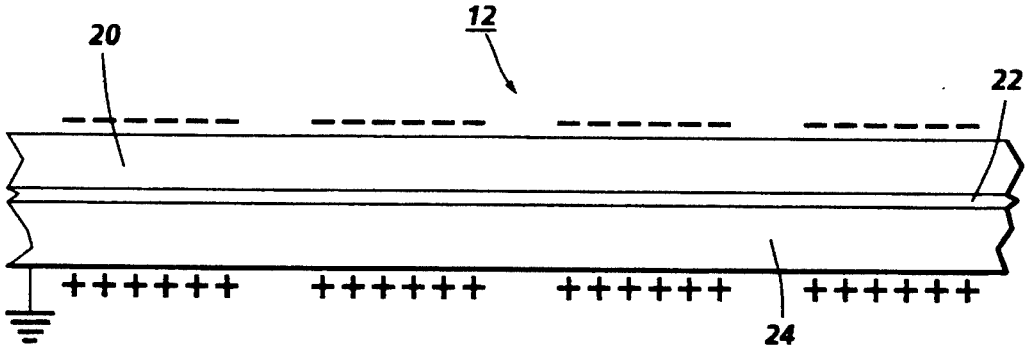
FIG. 2 depicts a charge retentive surface in the form of a uniformly charged photoreceptor.

The photoreceptor 12 is initially charged to uniform a negative polarity using a corona discharge device such as a DC scorotron 30. Providing a hole (+) injecting contact in the transport layer 24 results in a reservoir of charge for collapsing the field across the photoreceptor. As a result, no flooding is needed as in the case of the second step of the Canon NP process. Because of the hole injection, the initial charging step leaves a voltage across the overcoating only as indicated in FIG. 2. Material for hole injecting contact as disclosed in U.S. Pat. No. 4,467,023 is contemplated.

Next, simultaneously imagewise exposure with a high resolution raster output scanner (ROS) 32 and AC shunting of photoreceptor surface potential to zero volts with an AC scorotron 36 is effected. The ROS 32 has a resolution of 40 microns (dot to dot spacing) or approximately 600 dots per inch (DPI). It will be appreciated that a raster output scanner operating at a lower resolution could be used.

Operation of the ROS 32 as well as other components of the printing apparatus 10 is under the control of an electronic subsystem (ESS) 38 operatively connected to the ROS. A raster input scanner (RIS) 40 is used to digitize original document information for creating bit streams representative of original scanned images. The ROS is operated to form a plurality of perfectly registered charged area images.

Figure 3:
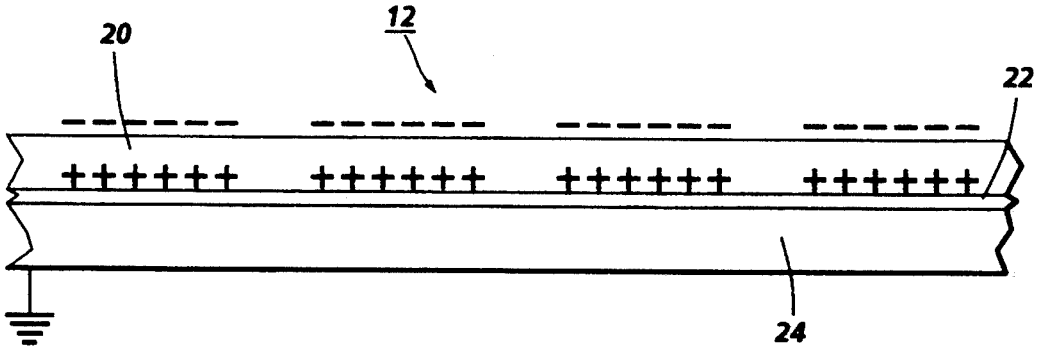
FIG. 3 depicts the effect of uniformly charging the photoreceptor of the present invention in the absence of illumination.
Figure 4:
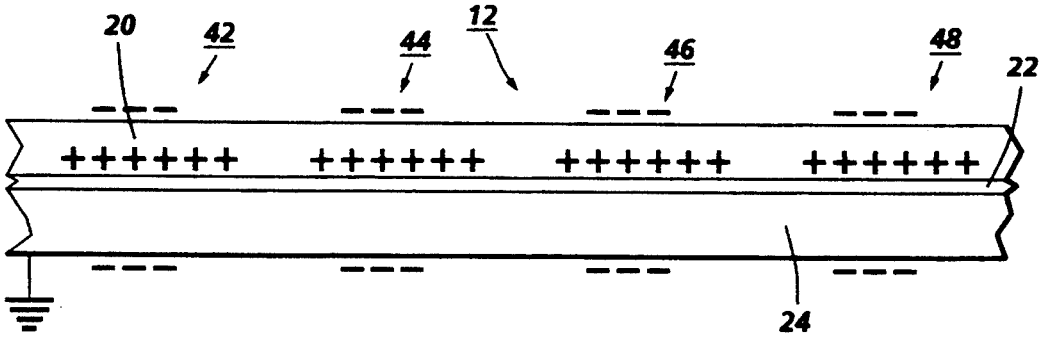
FIG. 4 depicts the photoreceptor of FIG. 3 subsequent to simultaneous exposure, using a high resolution ROS and shunting of the uniformly charged photoreceptor of FIG. 3.

As the result of the simultaneous imagewise exposure and AC shunting, four images 42, 44, 46 and 48, by way of example, are formed. As illustrated in FIG. 3, the images are electrostatically balanced, meaning that if they were to be moved past a toner development system no development would occur. However, upon flood exposure of one of the images 42, 44, 46 or 48, with a low resolution ROS, that image would become unbalanced and therefore developable.

After the simultaneous exposure and shunting step, the photoreceptor is moved past a low resolution ROS 50 which flood illuminates regions of the document to be developed at developer housing structure 52. Unlike the high resolution ROS 32, the ROS 50 operates to fully discharge the photoreceptor within a defined area thereof which corresponds to an image to be created. Thus, rather than operating in a pulsed (i.e."On"-"Off") mode it is operated in the continuously "On" mode except for being turned off at the boundaries delimiting the defined area. To this end the ROS 50 must be operative to turn off and on within ±0.01 to 0.1 inches of the aforementioned boundaries.

Figure 5:
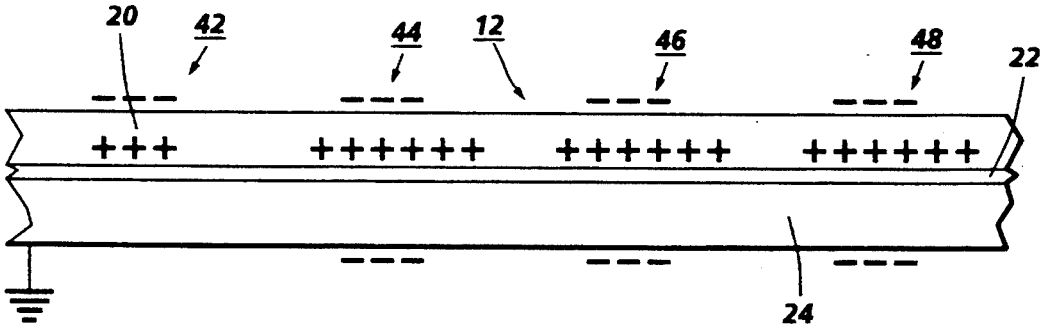
FIGS. 5 and 6 depict the condition of the photoreceptor of FIG. 4 subsequent to the formation of a first image using a low resolution ROS and a development system containing black developer.
Figure 6:
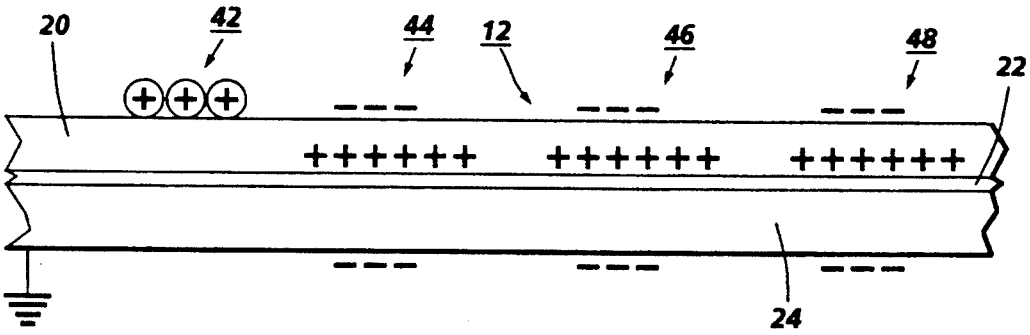

The unbalanced image 42 is depicted in FIG. 5. As can be seen from FIG. 5, the images 44, 46 and 48 remain balanced at this time. By way of example the developer housing structure 52 may contain a magnetic brush developer structure containing a developer mixture 54 of carrier particles and toner particles 55. The toner particles may comprise black pigment. Thus, when the portion of the photoreceptor containing the image 42 moves past the developer structure 52, black toner particles are deposited thereon as indicated in FIG. 6, such deposition being effected with magnetic brush rollers 56 and 57. These toner particles are oppositely charged to the charge of the image 42 on the photoreceptor. Thus, they are positively charged. The developer housing structure 52 is electrically biased to a negative bias voltage of approximately −200 volts with a a DC bias source 60.

Figure 7:
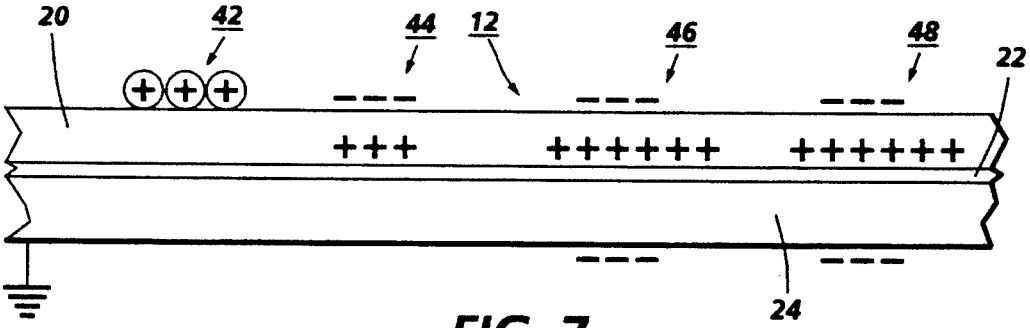
FIGS. 7 and 8 depict the condition of the photoreceptor of FIG. 6 subsequent to the formation of a first color image using a second low resolution ROS and a first color development system.
Figure 8:
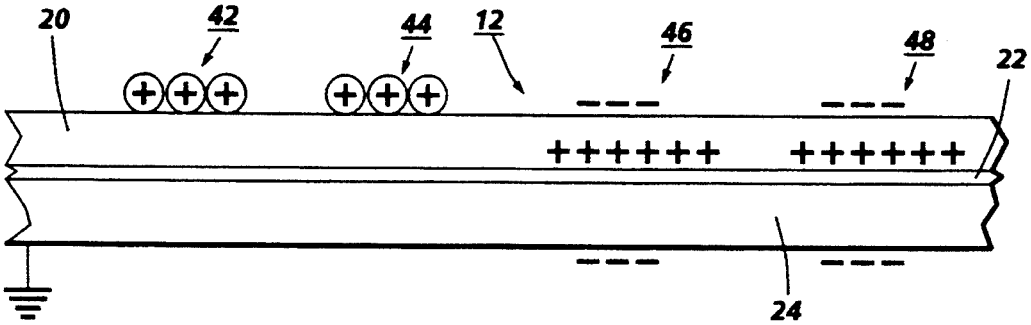

Following the development of the image 42 with black toner, the photoreceptor is moved past low resolution ROS 64 which flood illuminates regions of the document image thereby forming image 44 to be developed by a non-interactive developer structure 66. This causes image 44 to become unbalanced as indicated in FIG. 7. Developer structure 66 is preferably a non-interactive development system such as disclosed in U.S. Pat. No. 5,010,367 granted to Dan A. Hays on Apr. 23, 1991. It is adapted to deposit color toner 68 on image 44. The specific color is not critical. It may comprise one of the additive colors red, green and blue. Its charge polarity is the same as toner 55. Electrically biasing of the developer structure comprises applying a combination AC/DC voltage 70 to a pair of electrodes 72 disposed in a development zone 74 intermediate the photoreceptor 12 and a donor roll 76. A second combination AC/DC biasing arrangement 78 is provided for applying a suitable voltage between the donor roll 76 and the photoreceptor for controlling the position of the toner clouds formed as the result of the application of AC/DC voltage 70 to the wires or electrodes 72. FIG. 8 shows image 44 having, for example, red toner deposited thereon. Because the polarity of the developed image 42 is positive or a low negative voltage below the developer bias the positive red toner particles do not deposit on that image.

Figure 9:
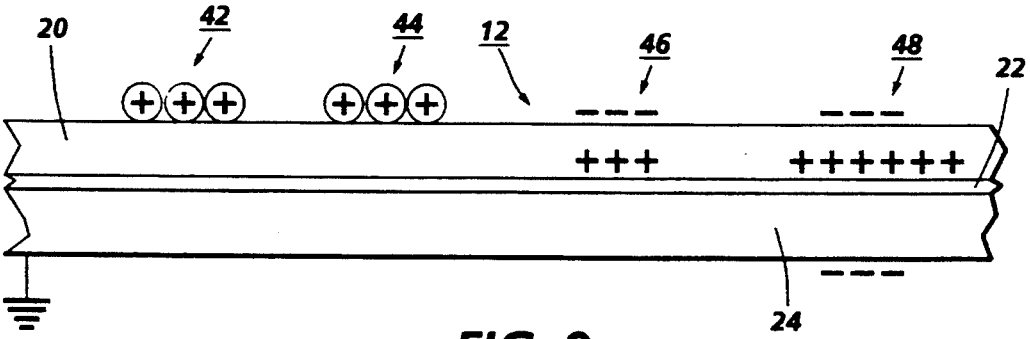
FIGS. 9 and 10 depict the condition of the photoreceptor of FIG. 8 subsequent to the formation of a second color image using a third low resolution ROS and a second color development system.
Figure 10:
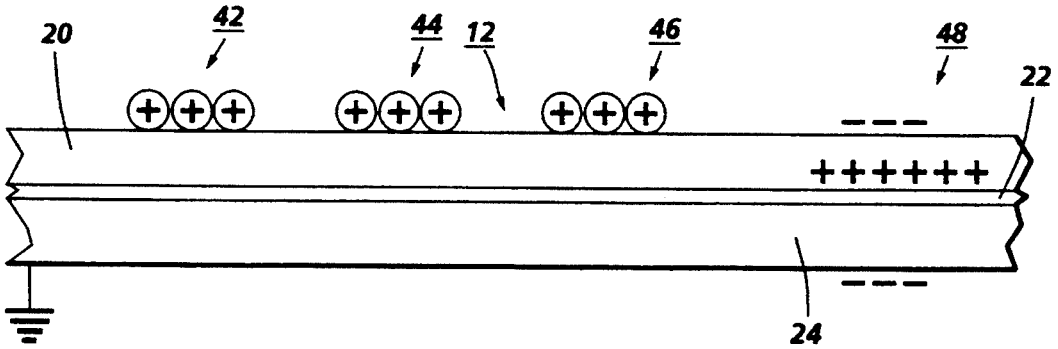
Figure 11:
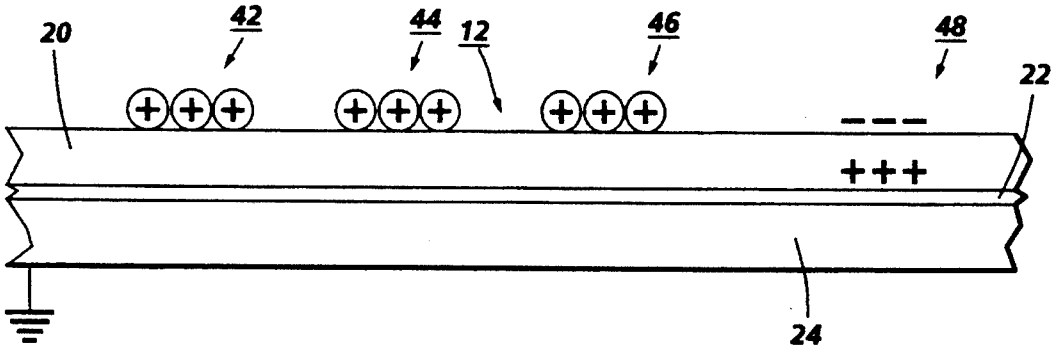
FIGS. 11 and 12 depict the condition of the photoreceptor of FIG. 10 subsequent to the formation of a third color image using a third low resolution ROS and a third color development system.
Figure 12:
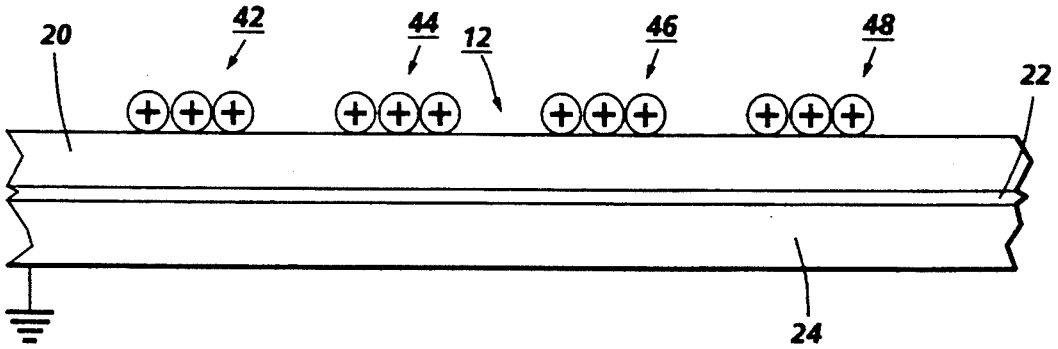

In like manner, a second highlight color image 46 is formed as the photoreceptor moves past a low resolution ROS 80 thereby causing the image 46 to become unbalanced as indicated in FIG. 9. Movement of image 46 past a non-interactive developer structure 82 causes the image 46 to be developed with blue toner particles 84 deposited by donor roll 76 of developer structure 82. All other members of the developer structure 82 are the same as corresponding members of developer structure 66.

The last of the images, 48 is created with a low resolution ROS 90 which flood illuminates regions of the document to be developed by a non-interactive developer structure 88. Green toner particles 96 are deposited on the image 48 with the non-interactive developer structure 88.

A combination metering and charging device 94 serves to load the donor rolls 76 with the appropriate toner material. For further details with regard to the device 94 reference may be had to U.S. Pat. No. 4,876,575 granted to Dan A. Hays on Oct. 24, 1989.

Subsequent to image development a sheet of support material 102 (FIG. 1) is moved into contact with the toner images at a transfer area. The sheet of support material is advanced to transfer area by conventional sheet feeding apparatus, not shown. Preferably, the sheet feeding apparatus includes a feed roll contacting the uppermost sheet of a stack copy sheets. The feed rolls rotate so as to advance the uppermost sheet from stack into a chute which directs the advancing sheet of support material into contact with photoconductive surface of belt 12 in a timed sequence so that the toner powder image developed thereon contacts the advancing sheet of support material.

The transfer area includes a transfer dicorotron 104 which sprays positive ions onto the backslide of sheet 102. This attracts the positively charged toner powder images from the belt 12 to sheet 102. A detack dicorotron 106 is also provided for facilitating stripping of the sheets from the belt 12.

After transfer, the sheet continues to move, onto a conveyor (not shown) which advances the sheet to fuser assembly 120 which permanently affixes the transferred powder images to sheet 102. Preferably, fuser assembly 120 comprises a heated fuser roller 122 and a backup roller 124. Sheet 102 passes between fuser roller 122 and backup roller 124 with the toner powder image contacting fuser roller 122. In this manner, the toner powder image is permanently affixed to sheet 102 after it is allowed to cool. After fusing, a chute, not shown, guides the advancing sheets 102 to a catch tray (not shown), for subsequent removal from the printing machine by the operator.

After the sheet of support material is separated from photoconductive surface of belt 12, the residual toner particles carried by the non-image areas on the photoconductive surface are removed therefrom. A cleaning housing 130 supports therewithin two cleaning brushes 132, 134 supported for counter-rotation with respect to the other and each supported in cleaning relationship with photoreceptor belt 12. Each brush 132, 134 is generally cylindrical in shape, with a long axis arranged generally parallel to photoreceptor belt 12, and transverse to photoreceptor movement direction 16. Brushes 132,134 each have a large number of insulative fibers mounted on base, each base respectively journaled for rotation (driving elements not shown). The brushes are typically detoned using a flicker bar and the toner so removed is transported with air moved by a vacuum source (not shown) through the gap between the housing and photoreceptor belt 12, through the insulative fibers and exhausted through a channel, not shown. A typical brush rotation speed is 1300 rpm, and the brush/photoreceptor interference is usually about 2 mm. Brushes 132, 134 beat against flicker bars (not shown) for the release of toner carried by the brushes and for effecting suitable tribo charging of the brush fibers.

Subsequent to cleaning, a discharge lamp 140 floods the photoconductive belt 12 with light to dissipate any residual negative electrostatic charges remaining prior to the charging thereof for the successive imaging cycles. To this end, a light pipe 142 is provided. Any non-uniform voltage left on the overcoating is incorporated into the uniform initial charge potential by the primary DC charging scortoron 30.

In operation, the step of simultaneously exposing a uniformly charge photoreceptor 12 to the high resolution ROS 32 and shunting thereof to zero volts with the scorotron 36 forms four, full contrast images, 42, 44, 46 and 48. The ROS 32 functions in a write "white" mode which means that these images are charged area (CAD) images. The output of the ROS 32 is determined in accordance with the information provided by the RIS 40 which is manipulated via the ESS 38 to operate the ROS 32. As pointed out above, these four images are electrostatically balanced thereby rendering them non-developable. Each of the four images is sequentially render developable by exposing it to one of the low resolution raster output scanners which exposure unbalances that image. Thus, when an image that has not been electrostatically unbalanced moves past one of more of the developer structures it will not be developed. All of the image pixels are at essentially the same voltage level which provides for the full contrast images attained with conventional xerography. Also, all of the toners are charged to the same polarity which makes it unnecessary to employ a pre transfer charging step. Developer packages (i.e. toner plus carrier) could be designed for different polarities.

While the description of the invention has been directed to the creation of spot next to spot color images, it will be appreciated that it would be desirable to use developers and more specifically toners which have the same color but which have physical properties which are different. For, example magnetic and non-magnetic toners could be employed fro developing different images.

What is claimed is:

1. A method of forming color images, said method including the steps of:

a. forming latent electrostatically balanced, non-developable, full contrast images on a photoreceptor wherein said non-developable images are formed by uniformly charging said photoreceptor and simultaneously selectively exposing with a high resolution raster output scanner said uniformly charged photoreceptor to image information and simultaneously shunting the surface potential of said photoreceptor to zero volts;

b. using a relatively low resolution raster output scanner, illuminating only a portion of said image receiver whereby only one of said electrostatically balanced images is rendered unbalanced and therefore developable;

c. developing said only one of said electrostatically balanced images; and d. repeating steps b and c for each of said images.

2. The method according to claim 1 wherein the resolution of said low resolution raster output scanner is operated in a non-pulsed mode.

3. The method according to claim 2 wherein said photoreceptor comprises an overcoat layer adhered to a generator layer which in turn is adhered to a charge transport layer.

4. Apparatus for forming images, said apparatus comprising:

an imaging member;

means for forming a plurality of latent electrostatically balanced, non-developable, full contrast images on a photoreceptor wherein said non-developable images are formed by uniformly charging said photoreceptor and simultaneously selectively exposing with a high resolution raster output scanner said uniformly charged photoreceptor to image information and simultaneously shunting the surface potential of said photoreceptor to zero volts;

a relatively low resolution raster output scanner for sequentially illuminating only a portion of said imaging member whereby only one of said plurality of electrostatically balanced images is rendered unbalanced thereby rendering it developable; and means for developing each of said plurality of images once each is rendered developable.

5. Apparatus according to claim 4 wherein the resolution of said relatively high resolution raster output scanner is in the order of 400 to 600 dots per inch.

6. Apparatus according to claim 5 wherein said photoreceptor comprises a relatively thick overcoat layer adhered to a generator layer which in turn is adhered to a charge transport layer.

* * * * *